US005580008A

United States Patent [19]

Koegler et al.

[11] Patent Number: 5,580,008

[45] Date of Patent: Dec. 3, 1996

[54] CHOPPER WITH ROTATABLE CUTTING TOOL AND STOPPING BODY

[75] Inventors: Hanswerner Koegler, Ottendorf; Juergen Dolata, Sebnitz, both of Germany

[73] Assignee: Robert Bosch GmbH, Stuttgart, Germany

[21] Appl. No.: 352,552

[22] Filed: Dec. 8, 1994

[30] Foreign Application Priority Data

Dec. 28, 1993 [DE] Germany ..... 43 44 738.4

[51] Int. Cl.[6] ..... B02C 18/04; B02C 18/22

[52] U.S. Cl. ..... 241/222; 241/235; 241/DIG. 30; 83/346; 83/505; 83/659

[58] Field of Search ..... 83/346, 347, 505, 83/659; 241/111, 112, 222, 235, DIG. 30

[56] References Cited

U.S. PATENT DOCUMENTS

| | | | |
|---|---|---|---|
| 598,745 | 8/1898 | Perky | 241/235 X |
| 753,304 | 3/1904 | Parry | 241/235 |
| 1,916,773 | 7/1933 | Shaler | 241/235 X |
| 2,306,427 | 12/1942 | Christman et al. | 241/275 X |
| 2,533,550 | 12/1950 | Blackwell | 241/235 X |
| 3,406,625 | 10/1968 | Kutchera et al. | 241/235 X |
| 4,613,087 | 9/1986 | Snyder . | |
| 5,320,287 | 1/1994 | Li | 241/235 X |
| 5,373,998 | 12/1994 | Carey-Yard | 241/235 X |

FOREIGN PATENT DOCUMENTS

| | | | |
|---|---|---|---|
| 0469380 | 5/1992 | European Pat. Off. . | |
| 1102532 | 3/1961 | Germany . | |
| 4004577 | 2/1990 | Germany . | |
| 564849 | 7/1977 | U.S.S.R. | 241/235 |

*Primary Examiner*—Timothy V. Eley
*Attorney, Agent, or Firm*—Michael J. Striker

[57] ABSTRACT

A chopper has a rotatable cutting tool provided with a plurality of cutting teeth, a stopping body having a surface which faces the cutting teeth and guides the chopping product. The surface extends substantially in an axial direction of the cutting teeth and is arranged at a distance from the cutting teeth. The cutting teeth during a cutting process are in operative connection with the chopping product. A rotatably supported pressing roller which is arranged in a distance-free manner relative to the cutting tool and forms a gap between the pressing roller and the cutting tool, while the stopping body having a working side which extends in the gap between the pressing roller and the cutting tool.

9 Claims, 1 Drawing Sheet

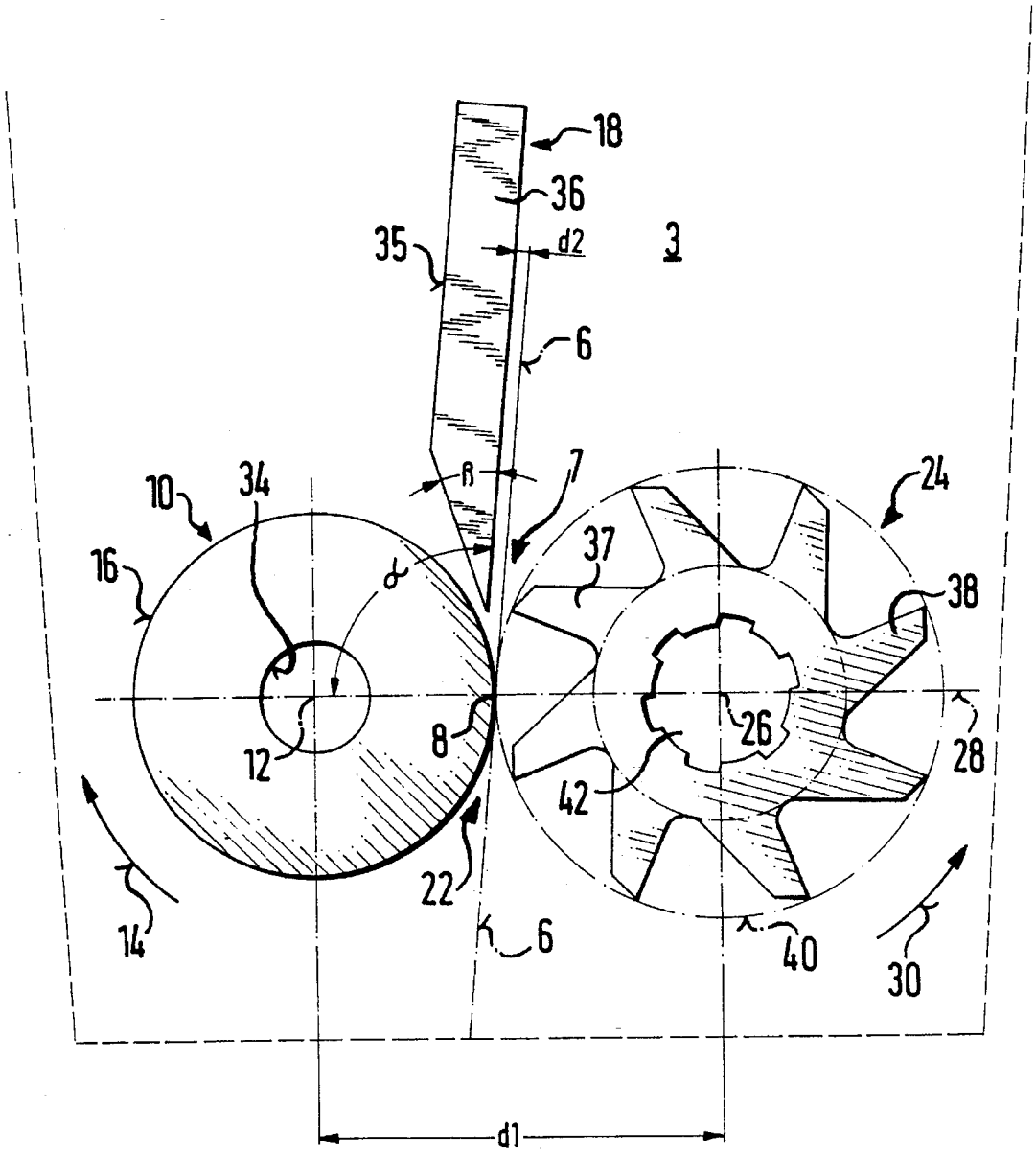
18
36
35
d2
3
6
β
7
10
34
24
16
37
38
α
12
8
26
28
42
22
14
6
40
30
d1

CHOPPER WITH ROTATABLE CUTTING TOOL AND STOPPING BODY

BACKGROUND OF THE INVENTION

The present invention relates to a chopper or a comminutor.

More particularly, it relates to a chopper with a rotatable cutting tool having cutting teeth and a stopping body with a working side located in a plane extending in an axial direction of the cutting teeth at a distance from them.

Choppers of the above mentioned general type are known in the art. One such chopper is disclosed for example in European Pat. document EP 469 380A1. In the chopper of this type the pressing plate is arranged without any distance relative to the cutting tool provided with the cutting teeth. The cutting point or in other words the place of separation of the chopping product, is therefore arranged relatively high. Thereby the chopping product is squeezed and thrown through a relatively long friction path, which presumes necessarily a high power drive for the cutting tool.

German document DE-AS 1 102 532 discloses a centrifugal mill in which the distance of the stopping bodies to the cutting teeth is gradually increased and reaches its minimum in the region of the separation. Also in this case the sliding tool must overcome the resistance of the squeezed material which is pulled along the stopping body before it is comminuted. The solutions proposed in the prior art have the common feature that in the case when undesirable and hard objects are located in the chopping product, for example rocks or other small metal pieces, the stopping bodies can be damaged especially in the region of the separation so that a clean cut of the chopping product is no longer guaranteed.

SUMMARY OF THE INVENTION

Accordingly, it is an object of the present invention to provide a cutter or a comminutor which avoids the disadvantages of the prior art.

In keeping with these objects and with others which will become apparent hereinafter, one feature of the present invention resides, briefly stated, in a cutter having a rotatable cutting tool with cutting teeth and a stopping body with a working side which faces the cutting teeth, guides the chopping product and is located in a plane, wherein in accordance with the present invention the cutting teeth which are in operative connection with the chopping product during the cutting process cooperate with a rotatably supported pressing roller which is arranged in a distance-free manner relative to the cutting tool, and the working side of the stopping body extends into a gap or depression formed between the pressing roller and the cutting tool.

When the chopper or comminutor is designed in accordance with the present invention, it has the disadvantage that with simply means (replacement of the cutting plate by a rotating roller) the output of the chopper can be increased with simultaneous reduction of the operational noise. This output increase is achieved in particular by minimizing the squeezing and friction path. The proposed drawing-in gap and the sliding friction-free supply over the roller radius to the cutting point also increases the maximum cutting knot diameter. By adherence of the chopping product to the roller the cutting tool is better cleared than with the use of the cutting plate. Moreover, the chopping product remains free from metal chips which otherwise are removed from the cutting plate. It is also important that a post-adjusting mechanism or in other words additional means for adjusting is no longer required. Finally, it is also important that also blocking chopping product is drawn through the chopper, and despite the use of inlet funnel which is needed for safety reasons, so that annoying post-stopping is dispensed with.

In accordance with another feature of the present invention, the rotary axis of the pressing roller extends substantially parallel to the rotary axis of the cutting tool.

In this construction the place of the separation is a straight line which extends parallel to the axis of the pressing roller and the cutting tool. The comminuted chopping product has therefore substantially the same length when for example it has long knots. The outer periphery of the pressing roller can have different shapes. It is advantageous however when the peripheries are cylindrical which leads to a uniform loading of the pressing roller and the cutting tool.

In accordance with another feature of the present invention, the stopping body is formed as a flat plate which reduces toward the gap. With this construction the distance between the stopping body and the place of the separation is minimized and dust formation between the stopping body and the place of the separation is excluded. When a chopper is such that the distance of the flat surface from a plane extending parallel to it and contacting the cutting tool in the working line (place of the separation) of the cutting tool and the pressing roller is equal to 0.5 to 10 mm, then the chopper can be adjusted to the corresponding cutting product in an optimal manner.

In accordance with a further advantageous embodiment of the invention, the plane which is defined by the rotary axes intersects the plane of the working surface under the angle $\alpha$ equal to 93°–125°. With these features the introduction of the chopping product into the gap is facilitated.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

The single figure of the drawings is a view schematically showing a machine in accordance with the present invention.

DESCRIPTION OF THE PREFERRED EMBODIMENTS

The chopper or comminutor in accordance with the present invention is shown schematically in the drawings only in its lower region. The chopper has a cutting tool 24 with a plurality of cutting teeth 37 and 38 which are uniformly distributed over the circumference. It further has a stopping body 18 with a working side 36 and a parallel opposite side 35, which faces the cutting teeth 37 and guides the chopping product. The working side 36 is located on a surface which extends in an axial direction of the cutting teeth 37, or in direction of the rotary axis 26 at a distance $d_2$ to it.

The cutting teeth 37 which during the chopping process are in operative connection with the chopping product cooperate with a rotatably supported pressing roller 10 which is arranged in a distance-free manner relative to the outer diameter of the cutting tool 24. The pressing roller 10, the cutting tool 24, and the stopping body 18 are arranged relative to one another so that the working side 36 extends into a definite gap 7 or depression provided between the pressing roller 10 and the cutting tool 24. The outer periphery 16 of the pressing roller 10 and the outer periphery 40 of the cutting tool 24 are cylindrical, and the rotary axis 12 of the pressing roller 10 extends substantially parallel to the rotary axis 26 of the cutting tool 24. As can be seen from the drawings, the stopping body 18 is formed as a flat plane which narrows toward the gap 7. A distance $d_2$ of the flat surface 36 from the plane 6 which extends parallel to the surface 36 and is tangential to the cutting tool 24 in the working plane 8 (place of the separation of the chopping product) of the cutting tool 24 and the pressing roller 10 amounts to several millimeters.

The chopping product is engaged by the teeth 38 in the gap 7 and is partially cut. The separating process itself starts when the cutting teeth 37 reach the working line 8.

The rotary axes 12 and 26 define a plane 28 which intersects the plane 6 under an angle $\alpha$ which in the shown example amounts to 96°. In general this angle can be somewhat smaller but also can be up to 125°. The radius of the pressing roller 10 which is composed of synthetic plastic material corresponds substantially to the radius of the cutting tool 24 and the part of the stopping body 18 which extends into the gap 7 reduces under an angle $\beta$ which in the shown example amounts to 25°. However, it can be smaller or greater up to 40°. It is however desirable when the angle $\beta$ is minimal so as to maintain minimal the distance between the lower tipped end of the stopping body 18 and the working line 8. This distance as a rule amounts to several millimeters and thereby with a very small angle $\beta$ the end piece of the stopping body 18 has a substantial weakening which can undesirably affect the cutting process. For adjusting the chopper to the chopping product in an optimal manner, the stopping body 18 in the region of the rear side 35 is supported by a not shown adjusting device, so as to change and adjust the distance $d_2$.

The chopper in the drawings and described hereinabove operates in the following manner.

The cutting tool 24 which is driven by a shaft 42 engages with its teeth 38 the chopping product accumulated in the region of the collecting space 3 and moves it to the working line 8. The cutting teeth 37 and 38 which move in direction of the arrow 30 and arranged on the periphery of the cutting tool 24 with constant distances from one another, move with a peripheral speed which guarantees a fast comminuting of the chopping product. The pressing roller 10 which moves in an opposite direction is freely supported on an axle 34 and during the cutting and comminuting process rotated in direction of the arrow 14. The chopped product falls from the gap 22 into a not shown container in which it is collected. Since the distance $d_1$ between the axes 12 and 26 from another corresponds to the sum of the radii of the pressing roller and the cutting tool 24, it is guaranteed that the chopping product is separated completely in the region of the working line 8.

Thus, the present invention deals with a noiseless chopper in which instead of the cutting plate a loosely rotating synthetic plastic roller is utilized and operates practically without wear.

It will be understood that each of the elements described above, or two or more together, may also find a useful application in other types of constructions differing from the types described above.

While the invention has been illustrated and described as embodied in a chopper, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A chopper, comprising a rotatable cutting tool provided with a plurality of cutting teeth; a stopping body having a surface which faces said cutting teeth and guides the chopping product, said surface extending substantially in an axial direction of said cutting teeth and being arranged at a distance from said cutting teeth, said cutting teeth during a cutting process being in operative connection with the chopping product; and a rotatably supported pressing roller which is arranged in a distance-free manner-relative to said cutting tool and forms a V-shaped contour between said pressing roller and said cutting tool, said stopping body having a working side which extends in said contour between said pressing roller and said cutting tool, said stopping body being formed as a flat plate which ends at a close distance toward said contour and which narrows there.

2. A chopper as defined in claim 1, wherein said pressing roller has a rotary axis which extends substantially parallel to a rotary axis of said cutting tool.

3. A chopper as defined in claim 1, wherein said pressing roller and said cutting tool define each a peripheral surface which is cylindrical.

4. A chopper as defined in claim 1, wherein said cutting tool and said pressing roller together form a working line, said stopping member having a flat surface extending in a plane which is spaced from said working line by 0.5–10 mm.

5. A chopper as defined in claim 1, wherein said pressing roller is composed of a synthetic plastic material.

6. A chopper as defined in claim 1, wherein said pressing roller has a radius which substantially corresponds to a radius of said cutting tool.

7. A chopper, comprising a rotatable cutting tool provided with a plurality of cutting teeth; a stopping body having a surface which faces said cutting teeth and guides the chopping product, said surface extending substantially in an axial direction of said cutting teeth and being arranged at a distance from said cutting teeth, said cutting teeth during a cutting process being in operative connection with the chopping product; and a rotatably supported pressing roller which is arranged in a distance-free manner relative to said cutting tool and forms a V-shaped contour between said pressing roller and said cutting tool, said stopping body having a working side which extends in said contour between said pressing roller and said cutting tool, said stopping body having a part which extends into said contour and narrows there with an angle equal to substantially 10–40°.

8. A chopper, comprising a rotatable cutting tool provided with a plurality of cutting teeth; a stopping body having a surface which faces said cutting teeth and guides a chopping product, said surface extending substantially in an axial direction of said cutting teeth and being arranged at a distance from said cutting teeth, said cutting teeth during a cutting process being in operative connection with the chopping product; and a rotatably supported pressing roller which is arranged in a distance-free manner relative to said cutting tool and forms a V-shaped contour between said pressing roller and said cutting tool, said stopping body having a working side which extends in said contour between said pressing roller and said cutting tool, said pressing roller and said cutting tool having rotary axes which together define an axis plane, said axis plane being inclined toward a plane which is parallel to said working side of said stopping body at an angle $\alpha$ equal substantially 93°–125°.

9. A chopper, comprising a rotatable cutting tool provided with a plurality of cutting teeth; a stopping body having a surface which faces said cutting teeth and guides a chopping product, said surface extending substantially in an axial direction of said cutting teeth and being arranged at a distance from said cutting teeth, said cutting teeth during a cutting process being in operative connection with the chopping product; and a rotatably supported pressing roller which is arranged in a distance-free manner relative to said cutting tool and forms a V-shaped contour between said pressing roller and said cutting tool, said stopping body having a working side which extends in said contour between said pressing roller and said cutting tool, said pressing roller being supported for free rotation and is turnable in an opposite direction relative to said cutting tool so that said working side is straight and the opposite side is angled at said end.

* * * * *